US011676551B2

(12) United States Patent
Liao

(10) Patent No.: US 11,676,551 B2
(45) Date of Patent: Jun. 13, 2023

(54) GAMMA VOLTAGE CORRECTION METHOD AND DEVICE, AND DISPLAY DEVICE

(71) Applicant: Shenzhen China Star Optoelectronics Semiconductor Display Technology Co., Ltd., Guangdong (CN)

(72) Inventor: Wenwu Liao, Guangdong (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 338 days.

(21) Appl. No.: 17/260,246

(22) PCT Filed: Dec. 25, 2020

(86) PCT No.: PCT/CN2020/139362
§ 371 (c)(1),
(2) Date: Jan. 14, 2021

(87) PCT Pub. No.: WO2022/120986
PCT Pub. Date: Jun. 16, 2022

(65) Prior Publication Data

US 2022/0406266 A1 Dec. 22, 2022

(30) Foreign Application Priority Data

Dec. 8, 2020 (CN) ..... 202011443005.3

(51) Int. Cl.
*G09G 3/30* (2006.01)
*G09G 3/36* (2006.01)
*G09G 3/3208* (2016.01)

(52) U.S. Cl.
CPC ..... *G09G 3/3607* (2013.01); *G09G 3/3208* (2013.01); *G09G 2310/08* (2013.01);
(Continued)

(58) Field of Classification Search
CPC ..... G09G 3/3208; G09G 3/3607; G09G 2310/08; G09G 2310/0278;
(Continued)

(56) References Cited

U.S. PATENT DOCUMENTS

2015/0262525 A1* 9/2015 Cha ..... G09G 3/20 345/212
2017/0124934 A1* 5/2017 Verbeure ..... G09G 3/3611
(Continued)

FOREIGN PATENT DOCUMENTS

CN 105074807 11/2015
CN 106373516 2/2017
(Continued)

*Primary Examiner* — Sanghyuk Park

(57) ABSTRACT

Embodiments of the present disclosure provide a gamma voltage correction method and device, and a display device, wherein a candidate refresh rate last determined in a current frame period of a display panel is used as a target refresh rate, and a gamma voltage corresponding to the target refresh rate is used as a gamma voltage at a display phase in a next frame period of the display panel to perform brightness correction, so that flashing of the display panel during refresh rate switching is prevented, and storage resources are saved.

20 Claims, 3 Drawing Sheets

(52) U.S. Cl.
CPC ..... *G09G 2320/0233* (2013.01); *G09G 2320/0247* (2013.01); *G09G 2320/0276* (2013.01); *G09G 2340/0435* (2013.01)

(58) Field of Classification Search
CPC ... G09G 2320/0233; G09G 2320/0247; G09G 2320/0276; G09G 2340/0435
See application file for complete search history.

(56) References Cited

U.S. PATENT DOCUMENTS

| | | | | |
|---|---|---|---|---|
| 2020/0005723 | A1* | 1/2020 | Kim | G09G 3/3688 |
| 2020/0402478 | A1* | 12/2020 | Her | G09G 3/3233 |

FOREIGN PATENT DOCUMENTS

| | | |
|---|---|---|
| CN | 110751933 | 2/2020 |
| CN | 110890073 | 3/2020 |
| CN | 111445839 | 7/2020 |

* cited by examiner

GAMMA VOLTAGE CORRECTION METHOD AND DEVICE, AND DISPLAY DEVICE

RELATED APPLICATIONS

This application is a National Phase of PCT Patent Application No. PCT/CN2020/139362 having International filing date of Dec. 25, 2020, which claims the benefit of priority of Chinese Patent Application No. 202011443005.3 filed on Dec. 8, 2020. The contents of the above applications are all incorporated by reference as if fully set forth herein in their entirety.

FIELD AND BACKGROUND OF THE INVENTION

Embodiments of the present disclosure relate to the field of display technology, and more particularly, to a gamma voltage correction method and device, and a display device.

A FREESYNC display panel refers to a display panel mounted with FREESYNC technology that dynamically adjusts a refresh rate of the display panel by changing an interval of a vertical blanking (VBlank) phase in a frame period of the display panel so that the refresh rate of the display panel matches a refresh rate of a video card, thereby solving a problem of screen tearing and fluctuation displayed on the display panel, and improving smoothness of the screen.

However, difference in the interval of the vertical blanking phase causes the display panel to generate leakage currents of different sizes, and the leakage currents of different sizes cause brightness of the screen displayed on the display panel to be different. Therefore, when the refresh rate of the display panel changes, the display panel flashes.

SUMMARY OF THE INVENTION

An embodiment of the present disclosure provides a gamma voltage correction method and a device, and a display device for solving a problem that a flicker phenomenon occurs when a refresh rate of an existing display panel changes.

According to a first aspect, an embodiment of the present disclosure provides a gamma voltage correction method for variable refresh rate mode of a display panel, wherein the gamma voltage correction method comprises:

Pre-storing gamma voltage data, a plurality of vertical blanking intervals, and a refresh rate corresponding to each of the vertical blanking intervals, wherein the gamma voltage data comprises gamma voltages corresponding to a first refresh rate and a second refresh rate that are not equal to each other;

Obtaining an interval of a vertical blanking phase in a current frame period in real time in the current frame period of the display panel;

Each time the interval reaches one of the vertical blanking intervals, determining a refresh rate corresponding to the interval as a candidate refresh rate, and if the candidate refresh rate is not equal to the first refresh rate and not equal to the second refresh rate, performing interpolation processing on the gamma voltage data based on an interpolation algorithm to obtain a gamma voltage corresponding to the candidate refresh rate; and Using the candidate refresh rate determined last time as a target refresh rate, and using a gamma voltage corresponding to the target refresh rate as a gamma voltage of a display phase in a next frame period of the display panel.

In some embodiments, the gamma voltage correction method further comprises:

Using a gamma voltage corresponding to the first refresh rate as the gamma voltage corresponding to the candidate refresh rate if the candidate refresh rate is equal to the first refresh rate; and Using a gamma voltage corresponding to the second refresh rate as the gamma voltage corresponding to the candidate refresh rate if the candidate refresh rate is equal to the second refresh rate.

In some embodiments, wherein in the current frame period of the display panel, the interval of the vertical blanking phase in the current frame period is obtained in real time, specifically comprising:

In the current frame period of the display panel, an end time of a display phase in the current frame period is used as a start time, and a time difference between the start time and a current time is used as the interval.

In some embodiments, each time the interval reaches one of the vertical blanking intervals, determining the refresh rate corresponding to the interval once, specifically comprising:

Each time the interval reaches one of the vertical blanking intervals, a refresh rate corresponding to the vertical blanking interval is used as the refresh rate corresponding to the interval.

In some embodiments, the display panel has a plurality of gray scales, and the gamma voltage comprises a plurality of sub-gamma voltages corresponding to the plurality of gray scales one-to-one.

In some embodiments, the first refresh rate is a highest refresh rate of the display panel and the second refresh rate is a lowest refresh rate of the display panel.

According to a second aspect, an embodiment of the present disclosure provides a gamma voltage correction device for variable refresh rate mode of a display panel, wherein the gamma voltage correction device comprises:

A storage module configured to pre-store gamma voltage data, a plurality of vertical blanking intervals, and a refresh rate corresponding to each of the vertical blanking intervals, wherein the gamma voltage data comprises gamma voltages corresponding to a first refresh rate and a second refresh rate that are not equal to each other;

An interval obtaining module, configured to obtain an interval of a vertical blanking phase in a current frame period of the display panel in real time;

A voltage obtaining module, configured to determine a refresh rate corresponding to the interval once every time the interval reaches one of the vertical blanking intervals as a candidate refresh rate, and if the candidate refresh rate is not equal to the first refresh rate and not equal to the second refresh rate, perform interpolation processing on the gamma voltage data based on an interpolation algorithm to obtain a gamma voltage corresponding to the candidate refresh rate; and A correction module, configured to use the candidate refresh rate determined last time as a target refresh rate, and use a gamma voltage corresponding to the target refresh rate as a gamma voltage of a display phase in a next frame period of the display panel.

In some embodiments, the voltage obtaining module is further configured to:

Using a gamma voltage corresponding to the first refresh rate as the gamma voltage corresponding to the candidate refresh rate if the candidate refresh rate is equal to the first refresh rate; and Using a gamma voltage corresponding to the second refresh rate as the gamma voltage corresponding to the candidate refresh rate if the candidate refresh rate is equal to the second refresh rate.

In some embodiments, the interval obtaining module is specifically configured to:

In the current frame period of the display panel, an end time of a display phase in the current frame period is used as a start time, and a time difference between the start time and a current time is used as the interval.

In some embodiments, the voltage obtaining module is specifically configured to:

Each time the interval reaches one of the vertical blanking intervals, a refresh rate corresponding to the vertical blanking interval is used as the refresh rate corresponding to the interval.

In some embodiments, the display panel has a plurality of gray scales, and the gamma voltage comprises a plurality of sub-gamma voltages corresponding to the plurality of gray scales one-to-one.

In some embodiments, the first refresh rate is a highest refresh rate of the display panel and the second refresh rate is a lowest refresh rate of the display panel.

According to a third aspect, the present disclosure provides a display device comprising:

A display panel and a gamma voltage correction device; wherein,

The gamma voltage correction device comprises:

A storage module configured to pre-store gamma voltage data, a plurality of vertical blanking intervals, and a refresh rate corresponding to each of the vertical blanking intervals, wherein the gamma voltage data comprises gamma voltages corresponding to a first refresh rate and a second refresh rate that are not equal to each other;

An interval obtaining module, configured to obtain an interval of a vertical blanking phase in a current frame period of the display panel in real time;

A voltage obtaining module, configured to determine a refresh rate corresponding to the interval once every time the interval reaches one of the vertical blanking intervals as a candidate refresh rate, and if the candidate refresh rate is not equal to the first refresh rate and not equal to the second refresh rate, perform interpolation processing on the gamma voltage data based on an interpolation algorithm to obtain a gamma voltage corresponding to the candidate refresh rate; and A correction module, configured to use the candidate refresh rate determined last time as a target refresh rate, and use a gamma voltage corresponding to the target refresh rate as a gamma voltage of a display phase in a next frame period of the display panel.

In some embodiments, the voltage obtaining module is further configured to:

Use a gamma voltage corresponding to the first refresh rate as the gamma voltage corresponding to the candidate refresh rate if the candidate refresh rate is equal to the first refresh rate; and Use a gamma voltage corresponding to the second refresh rate as the gamma voltage corresponding to the candidate refresh rate if the candidate refresh rate is equal to the second refresh rate.

In some embodiments, the interval obtaining module is specifically configured to:

In the current frame period of the display panel, an end time of a display phase in the current frame period is used as a start time, and a time difference between the start time and a current time is used as the interval.

In some embodiments, the voltage obtaining module is specifically configured to:

Each time the interval reaches one of the vertical blanking intervals, a refresh rate corresponding to the vertical blanking interval is used as the refresh rate corresponding to the interval.

In some embodiments, the display panel has a plurality of gray scales, and the gamma voltage comprises a plurality of sub-gamma voltages corresponding one-to-one to the plurality of gray scales.

In some embodiments, the first refresh rate is a highest refresh rate of the display panel and the second refresh rate is a lowest refresh rate of the display panel.

In some embodiments, the display device further comprises:

A timing controller, a scan driving circuit, and a data driving circuit; wherein, The gamma voltage correction device and the scan driving circuit are respectively electrically connected to the timing controller, the data driving circuit is electrically connected to the gamma voltage correction device, and the display panel is respectively electrically connected to the scan driving circuit and the data driving circuit.

In some embodiments, the display device is a liquid crystal display device or an organic light emitting diode display device.

Beneficial effect: according to the gamma voltage correction method provided by the embodiment of the present disclosure, in the variable refresh rate mode of the display panel, the refresh rate of the display panel and the gamma voltage corresponding to the refresh rate are continuously determined with the passage of time in the vertical blanking stage of the current frame period of the display panel, and the gamma voltage corresponding to the last obtained refresh rate is used as the gamma voltage of the display phase in the next frame period of the display panel, so that the gamma voltage of the display panel can be changed along with the change of the refresh rate in the display phase in the next frame period of the display panel, so that the brightness of the display panel before and after the refresh rate switching is uniform or nearly uniform, the occurrence of flickering phenomenon is prevented, and the display effect is improved. Further, since the interpolation algorithm is introduced into the method, the pre-stored gamma voltage data comprises only the gamma voltages corresponding to the two refresh rates of the display panel, so that the gamma voltages corresponding to the refresh rates other than the two refresh rates can be obtained without storing the gamma voltages corresponding to the refresh rates corresponding to each vertical blanking interval, thereby saving storage resources.

DESCRIPTION OF SPECIFIC EMBODIMENTS OF THE INVENTION

In order that the objects, technical solutions, and effects of the present disclosure may be made clearer and clearer, the present disclosure will now be described in further detail with reference to the accompanying drawings in which examples are taken together. It is to be understood that the specific embodiments described herein are merely illustrative of the present disclosure and are not intended to limit the present disclosure.

An embodiment of the present disclosure provides a gamma voltage correction method for solving the problem that a flickering phenomenon occurs when a refresh rate of a display panel changes in the prior art, which enables brightness of the display panel when the refresh rate changes to be consistent or nearly consistent, thereby making it difficult for a human eye to perceive the flickering phenomenon and improving a display effect of the display panel.

Figure 1:
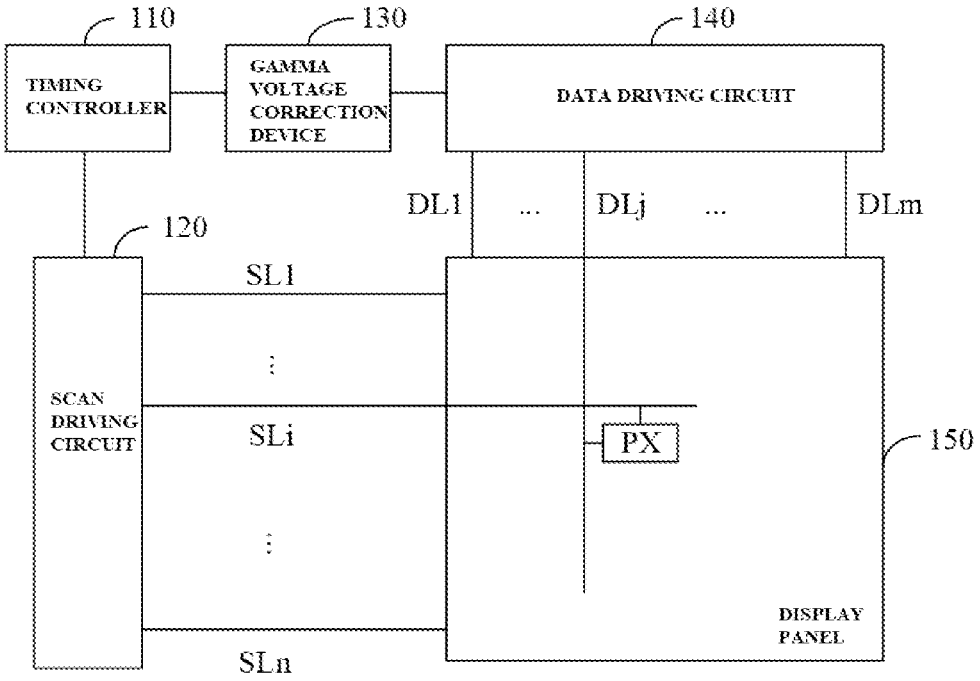
FIG. 1 is a schematic diagram of an application scenario of a gamma voltage correction method according to an embodiment of the present disclosure.

In order to more clearly describe the gamma voltage correction method provided in the embodiment of the present disclosure, an application scenario of the method is first described. Referring to FIG. 1, FIG. 1 is a schematic diagram of an application scenario of a gamma voltage correction method according to an embodiment of the present disclosure. The application scenario is specifically a display device. The display device comprises:

A timing controller 110, a scan driving circuit 120, a gamma voltage correction device 130, a data driving circuit 140, and a display panel 150. The scan driving circuit 120 and the gamma voltage correction device 130 are electrically connected to the timing controller 110, the data driving circuit 140 is electrically connected to the gamma voltage correction device 130, and the display panel 150 is electrically connected to the scan driving circuit 120 and the data driving circuit 140, respectively.

Here, the display panel 150 comprises a plurality of scan lines (SL1 to SLn shown in FIG. 1, n being a positive integer), a plurality of data lines (DL1 to DLm shown in FIG. 1, m being a positive integer), and a plurality of pixels. The plurality of pixels are arranged in a plurality of pixel regions obtained by dividing the plurality of scan lines and the plurality of data lines, respectively, and each pixel is connected to one scan line and one data line. The pixel PX shown in FIG. 1 is connected to the scan line SL1 (i is a positive integer) and the data line DLj (j is a positive integer). It should be noted that although FIG. 1 shows only one pixel, it should be understood that there is a corresponding pixel for each possible combination of the scan lines SL1 to SLn and the data lines DL1 to DLm.

It should be noted that the application scenario shown in FIG. 1 is not a limitation on the gamma voltage correction method provided in the embodiment of the present disclosure. Other application scenarios similar to the application scenario, if the method can be implemented, can also be used as the application scenario of the method. Other application scenarios in which the method can be implemented are not specifically described in the embodiment of the present disclosure.

Figure 2:
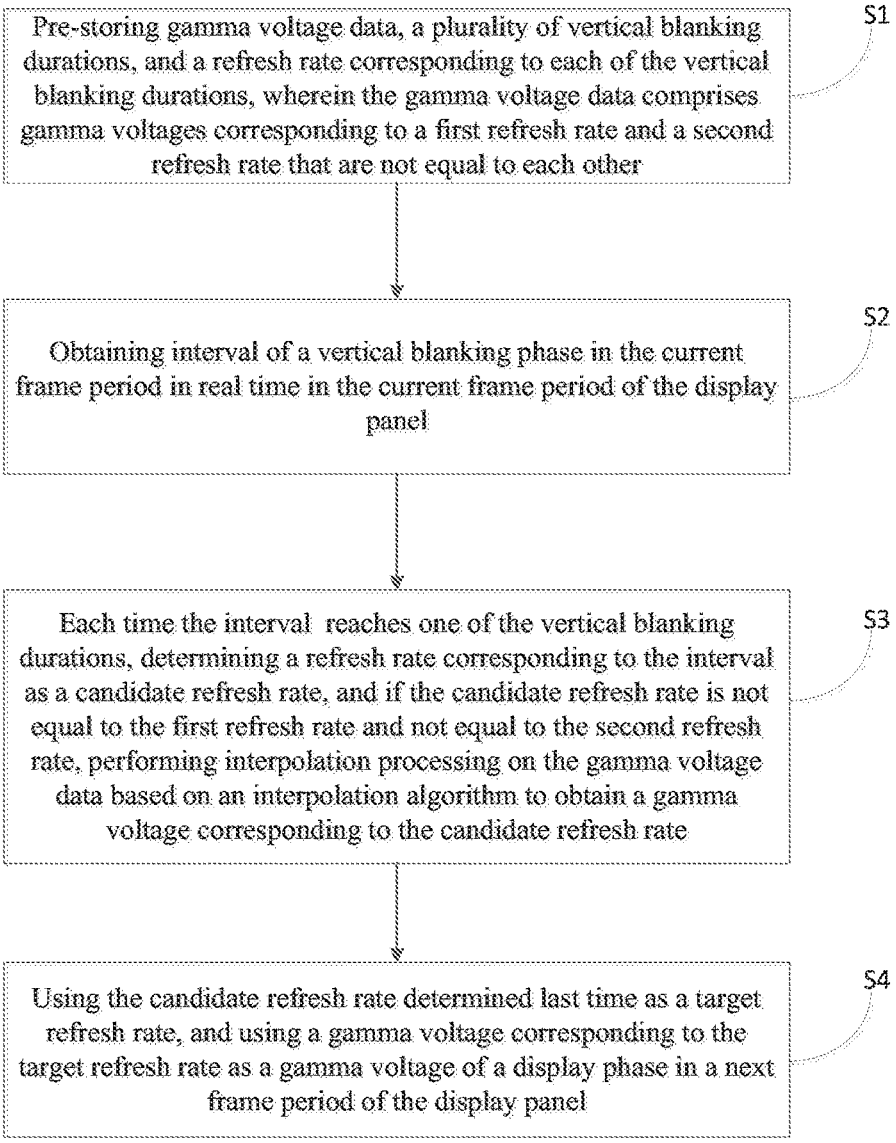
FIG. 2 is a flowchart of the gamma voltage correction method according to an embodiment of the present disclosure.

The gamma voltage correction method provided by the embodiment of the present disclosure is described in detail below in connection with the application scenario shown in FIG. 1. Referring to FIG. 2, which is a flowchart of a gamma voltage correction method according to an embodiment of the present disclosure, the method is specifically applied to a gamma voltage correction device and is applied to a variable refresh rate mode of a display panel. It should be noted that the variable refresh rate mode of the display panel refers to a refresh rate switching mode, and the method comprises:

Step S1, pre-storing gamma voltage data, a plurality of vertical blanking intervals, and a refresh rate corresponding to each of the vertical blanking intervals, wherein the gamma voltage data comprises gamma voltages corresponding to a first refresh rate and a second refresh rate that are not equal to each other.

Specifically, gamma voltage data including gamma voltages respectively corresponding to two refresh rates different from each other of the display panel are stored in the gamma voltage correction device in advance. Wherein the two refresh rates are a first refresh rate and a second refresh rate, the first refresh rate is preferably the highest refresh rate of the display panel, the second refresh rate is preferably the lowest refresh rate of the display panel, and the gamma voltage corresponding to each refresh rate comprises a plurality of sub-gamma voltages corresponding to the plurality of gray scales of the display panel.

A period between the start of displaying one frame of image and the start of displaying the next frame of image is referred to as a frame period, which comprises a display phase and a vertical blanking phase. A refresh rate corresponding to an interval of a plurality of vertical blanking phases (i.e., a vertical blanking interval) and each vertical blanking interval is stored in the gamma voltage correction device in advance. It should be noted that the number of pre-stored vertical blanking intervals can be set according to actual conditions. If the number of pre-stored vertical blanking intervals is greater, the refresh rate stored in advance is larger, and the accuracy of the gamma voltage correction method provided in the embodiments of the present disclosure is higher.

For ease of explanation, it is assumed that the variable refresh rate interval of the display panel is 50-120 Hz, the gray scale interval is 0-255 gray scales, the first refresh rate is 120 Hz, and the second refresh rate is 50 Hz. The gamma voltage corresponding to the first refresh rate 120 Hz comprises a sub-gamma voltage a0 corresponding to the gray scale 0 and a sub-gamma voltage a1 corresponding to the gray scale 1 . . . and a sub-gamma voltage a255 corresponding to the gray scale 255. The gamma voltage corresponding to the second refresh rate 50 Hz comprises a sub-gamma voltage b0 corresponding to the gray scale 0 and a sub-gamma voltage b1 corresponding to the gray scale 1 . . . and a sub-gamma voltage b255 corresponding to the gray scale 255. Assuming that the plurality of pre-stored vertical blanking intervals are 1, 2, 4, 7, 9, 12, 20, 30, and 45, respectively, the plurality of pre-stored vertical blanking intervals are 120 Hz, 110 Hz, 100 Hz, 90 Hz, 80 Hz, 70 Hz, 60 Hz, and 50 Hz, respectively. It should be noted that the values of the pre-stored gamma voltage data, the plurality of vertical blanking intervals, and the refresh rate corresponding to each vertical blanking interval are only one example and are not limited to the gamma voltage correction method provided in the embodiment of the present disclosure.

Step S2: in the current frame period of the display panel, the interval of the vertical blanking phase in the current frame period is acquired in real time.

Figure 3:
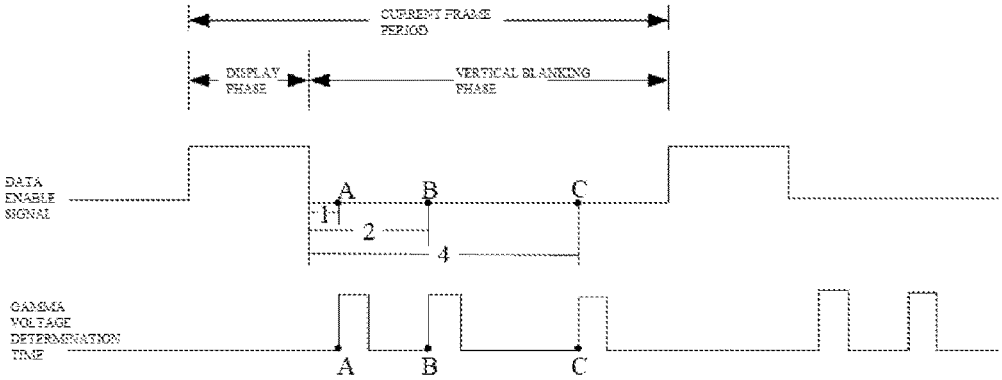
FIG. 3 is a schematic diagram of a correspondence between a data enable signal and a gamma voltage determination time according to an embodiment of the present disclosure.

Specifically, the timing controller receives the image data input from the external source, and parses the data enable signal according to the image data. Referring to FIG. 3, two signals are shown, in which the signal located above is the data enable signal, and the data enable signal shows a plurality of frame periods of the display panel. In the current frame period of the display panel, the gamma voltage correction device takes the end time of the display phase in the current frame period as the start time, acquires the time difference between the current time and the start time in real time, and uses the time difference as the interval of the vertical blanking phase in the current frame period acquired in real time.

Step S3: each time the interval reaches one of the vertical blanking interval, determining a refresh rate corresponding to the interval as a candidate refresh rate, and if the candidate refresh rate is not equal to the first refresh rate and not equal to the second refresh rate, performing interpolation processing on the gamma voltage data based on an interpolation algorithm to obtain a gamma voltage corresponding to the candidate refresh rate.

Specifically, in the current frame period of the display panel, the gamma voltage correction device acquires the interval of the vertical blanking phase in the current frame period in real time. For example, referring to FIG. 3, two signals are shown, in which the signal located above is a data enable signal, and the signal located below shows a time point at which the gamma voltage is determined. The steps are described below in connection with the two signals in FIG. 3.

With the passage of time, the interval reaches a pre-stored vertical blanking interval 1 at time A, and a refresh rate 120 Hz corresponding to the vertical blanking interval 1 is used as a candidate refresh rate to determine whether the candidate refresh rate 120 Hz is equal to the first refresh rate 120 Hz or the second refresh rate 50 Hz. Since the candidate refresh rate 120 Hz is equal to the first refresh rate 120 Hz, a gamma voltage corresponding to the pre-stored first refresh rate 120 Hz is used as a gamma voltage corresponding to the candidate refresh rate 120 Hz at time A. With the passage of time, the interval reaches a pre-stored vertical blanking interval 2 at time B, and a refresh rate 110 Hz corresponding to the vertical blanking interval 2 is used as a candidate refresh rate to determine whether the candidate refresh rate 110 Hz is equal to the first refresh rate 120 Hz or the second refresh rate 50 Hz. Since the candidate refresh rate 110 Hz is not equal to the first refresh rate 120 Hz and is not equal to the second refresh rate 50 Hz, interpolation processing is performed on the gamma voltage corresponding to the first refresh rate 120 Hz and the gamma voltage corresponding to the second refresh rate 50 Hz based on the interpolation algorithm at the time B to obtain the gamma voltage corresponding to the candidate refresh rate 110 Hz. By analogy, details are not described herein.

It should be noted that the interpolation algorithm is preferably a linear interpolation method. Performing interpolation processing on the gamma voltage corresponding to the first refresh rate 120 Hz and the gamma voltage corresponding to the second refresh rate 50 Hz based on the interpolation algorithm to obtain the gamma voltage corresponding to the candidate refresh rate 110 Hz. Specifically, performing interpolation on the sub-gamma voltage a0 corresponding to the 120 Hz and the sub-gamma voltage b0 corresponding to the 50 Hz based on the interpolation algorithm to obtain the sub-gamma voltage c0 corresponding to the 110 Hz (corresponding to the gray scale 0). Interpolating the sub-gamma voltage a1 corresponding to 120 Hz and the sub-gamma voltage b1 corresponding to 50 Hz based on the interpolation algorithm to obtain the sub-gamma voltage c1 corresponding to 110 Hz (corresponding to gray scale 1). The sub-gamma voltage a255 corresponding to 120 Hz and the sub-gamma voltage b255 corresponding to 50 Hz are interpolated based on the interpolation algorithm to obtain the sub-gamma voltage c255 corresponding to 110 Hz (corresponding to the gray scale 255).

Step S4, using the candidate refresh rate determined last time as the target refresh rate, and using the gamma voltage corresponding to the target refresh rate as the gamma voltage of the display phase in the next frame period of the display panel.

Specifically, in the current frame period of the display panel, the gamma voltage correction device uses the last determined candidate refresh rate as the target refresh rate. For example, referring to FIG. 3, with the passage of time, the last determined candidate refresh rate is 100 Hz determined at time C (interval 4), 100 Hz is used as the target refresh rate, and the gamma voltage corresponding to 100 Hz is used as the gamma voltage of the display phase in the next frame period of the display panel, and the display phase in the next frame period of the display panel is corrected for brightness by the gamma voltage corresponding to 100 Hz.

According to the gamma voltage correction method provided by the embodiment of the present disclosure, in the variable refresh rate mode of the display panel, the refresh rate of the display panel and the gamma voltage corresponding to the refresh rate are continuously determined with the passage of time in the vertical blanking phase of the current frame period of the display panel, and the gamma voltage corresponding to the last acquired refresh rate is used as the gamma voltage of the display phase in the next frame period of the display panel, so that the gamma voltage of the display panel can be changed along with the change of the refresh rate in the display phase in the next frame period of the display panel, so that the brightness of the display panel before and after the refresh rate switching is uniform or nearly uniform, the occurrence of flickering phenomenon is prevented, and the display effect is improved. Further, since the interpolation algorithm is introduced into the method, the pre-stored gamma voltage data comprises only two refresh rates of the display panel and gamma voltages corresponding to the two refresh rates, so that the gamma voltages corresponding to refresh rates other than the two refresh rates can be obtained without storing the gamma voltages corresponding to refresh rates corresponding to each vertical blanking interval, thereby saving storage resources.

Based on the above embodiment, the gamma voltage correction method further comprises:

Using a gamma voltage corresponding to the first refresh rate as a gamma voltage corresponding to the candidate refresh rate if the candidate refresh rate is equal to the first refresh rate. Using a gamma voltage corresponding to the second refresh rate as a gamma voltage corresponding to the candidate refresh rate if the candidate refresh rate is equal to the second refresh rate.

Specifically, for example, with the passage of time, if the interval reaches the pre-stored vertical blanking interval 1, the refresh rate 120 Hz corresponding to the vertical blanking interval 1 is used as the candidate refresh rate, and whether the candidate refresh rate 120 Hz is equal to the first refresh rate 120 Hz or the second refresh rate 50 Hz is determined. Since the candidate refresh rate 120 Hz is equal to the first refresh rate 120 Hz, the gamma voltage corresponding to the pre-stored first refresh rate 120 Hz is used as the gamma voltage corresponding to the candidate refresh rate 120 Hz. If the interval reaches the pre-stored vertical blanking interval 45, the refresh rate 50 Hz corresponding to the vertical blanking interval 45 is used as the candidate refresh rate, and whether the candidate refresh rate 50 Hz is equal to the first refresh rate 120 Hz or the second refresh rate 50 Hz is determined. Since the candidate refresh rate 50 Hz is equal to the second refresh rate 50 Hz, the gamma voltage corresponding to the pre-stored second refresh rate 50 Hz is used as the gamma voltage corresponding to the candidate refresh rate 50 Hz.

Based on the above embodiment, in the current frame period of the display panel, the interval of the vertical blanking phase in the current frame period is obtained in real time, specifically comprising:

In the current frame period of the display panel, an end time of the display phase in the current frame period is used as a start time, and a time difference between the start time and the current time is used as the interval.

Specifically, in the current frame period of the display panel, the end time of the display phase in the current frame period is taken as the start time, and the time difference between the current time and the start time is obtained in real time as the interval of the vertical blanking phase in the current frame period obtained in real time.

Based on the above embodiment, each time the interval reaches one of the vertical blanking intervals, a refresh rate corresponding to the interval is determined, specifically comprising:

Each time the interval reaches one of the vertical blanking intervals, a refresh rate corresponding to the vertical blanking interval is used as a refresh rate corresponding to the interval.

Specifically, for example, with the passage of time, if the interval reaches the pre-stored vertical blanking interval 1, the refresh rate 120 Hz corresponding to the vertical blanking interval 1 is used as the candidate refresh rate. If the interval reaches the pre-stored vertical blanking interval 2, the refresh rate 110 Hz corresponding to the vertical blanking interval 2 is used as the candidate refresh rate. By analogy, details are not described herein.

Based on the above embodiment, the display panel has a plurality of gray scales, and the gamma voltage comprises a plurality of sub-gamma voltages corresponding to the plurality of gray scales one-to-one.

Based on the above embodiment, the first refresh rate is the highest refresh rate of the display panel, and the second refresh rate is the lowest refresh rate of the display panel.

Figure 4:
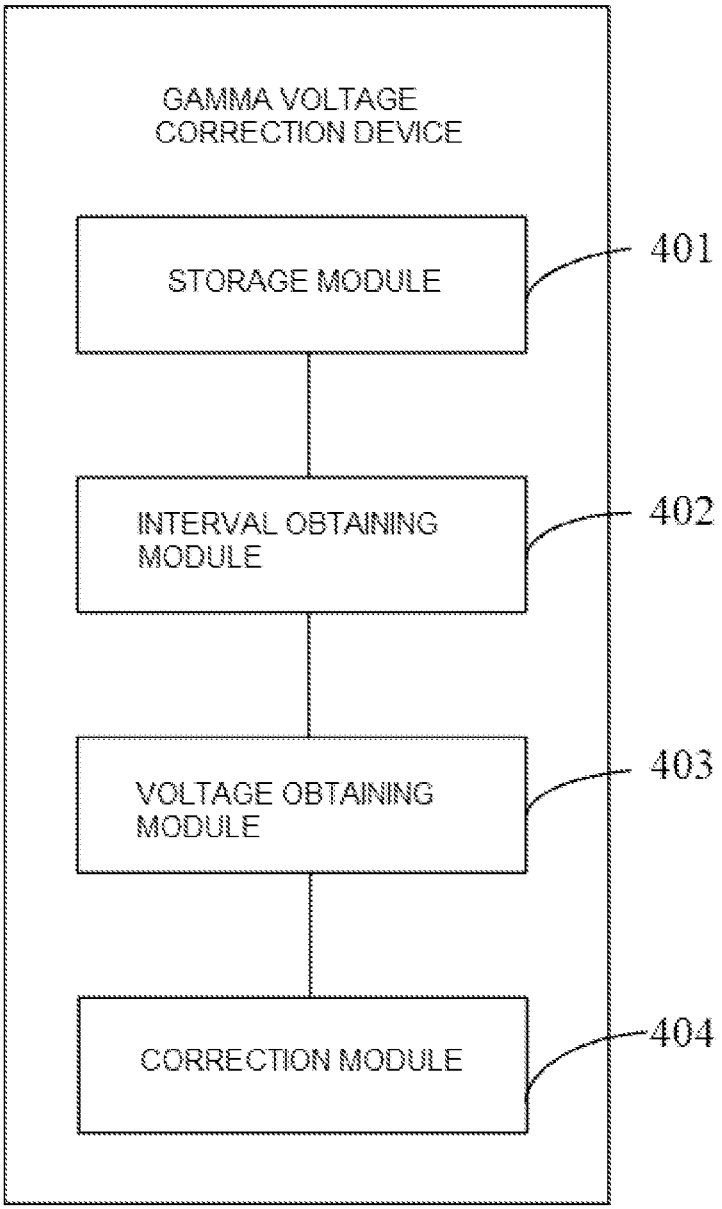
FIG. 4 is a schematic structural diagram of a gamma voltage correction device according to an embodiment of the present disclosure.

Referring to FIG. 4, FIG. 4 is a schematic structural diagram of a gamma voltage correction device according to an embodiment of the present disclosure. The device comprises:

A storage module 401, configured to pre-store gamma voltage data, a plurality of vertical blanking intervals, and a refresh rate corresponding to each of the vertical blanking intervals, wherein the gamma voltage data comprises gamma voltages corresponding to a first refresh rate and a second refresh rate that are not equal to each other; an interval obtaining module 402, configured to obtain interval of a vertical blanking phase in the current frame period of the display panel in real time; a voltage obtaining module 403, configured to determine a refresh rate corresponding to the interval once every time the interval reaches one of the vertical blanking intervals as a candidate refresh rate, and if the candidate refresh rate is not equal to the first refresh rate and not equal to the second refresh rate, perform interpolation processing on the gamma voltage data based on an interpolation algorithm to obtain a gamma voltage corresponding to the candidate refresh rate; a correction module 404, configured to use the candidate refresh rate determined last time as a target refresh rate, and use a gamma voltage corresponding to the target refresh rate as a gamma voltage of a display phase in a next frame period of the display panel.

Specifically, the gamma voltage correction device provided in the embodiment of the present disclosure is used to perform the gamma voltage correction method provided in any one of the above embodiments. Since the method has been described in detail in the above embodiment, reference is made to the above method embodiment for a detailed description of the device, and details are not described herein again. According to the gamma voltage correction device provided in the embodiment of the present disclosure, in the variable refresh rate mode of the display panel, the refresh rate of the display panel and the gamma voltage corresponding to the refresh rate are continuously determined with the passage of time in the vertical blanking phase of the current frame period of the display panel, and the gamma voltage corresponding to the last obtained refresh rate is used as the gamma voltage of the display phase in the next frame period of the display panel, so that the gamma voltage of the display panel can be changed along with the change of the refresh rate in the display phase in the next frame period of the display panel, so that the brightness of the display panel before and after the refresh rate switching is uniform or nearly uniform, the occurrence of flickering phenomenon is prevented, and the display effect is improved. Further, since the interpolation algorithm is introduced into the device, the pre-stored gamma voltage data comprises only two refresh rates of the display panel and gamma voltages corresponding to the two refresh rates, so that the gamma voltages corresponding to refresh rates other than the two refresh rates can be obtained without storing the gamma voltages corresponding to refresh rates corresponding to each vertical blanking interval, thereby saving storage resources.

Based on the above embodiment, the voltage obtaining module in the embodiment of the present disclosure is further configured to:

Using a gamma voltage corresponding to the first refresh rate as a gamma voltage corresponding to the candidate refresh rate if the candidate refresh rate is equal to the first refresh rate. Using a gamma voltage corresponding to the second refresh rate as a gamma voltage corresponding to the candidate refresh rate if the candidate refresh rate is equal to the second refresh rate.

Based on the above embodiment, the interval obtaining module in the embodiment of the present disclosure is specifically configured to:

In a current frame period of the display panel, an end time of a display phase in the current frame period is used as a start time, and a time difference between the start time and the current time is used as the interval.

Based on the above embodiment, the voltage obtaining module in the embodiment of the present disclosure is specifically configured to:

Each time the interval reaches one of the vertical blanking intervals, a refresh rate corresponding to the vertical blanking interval is used as a refresh rate corresponding to the interval.

Based on the above embodiment, the display panel in the embodiment of the present disclosure has a plurality of gray scales, and the gamma voltage comprises a plurality of sub-gamma voltages corresponding to the plurality of gray scales one-to-one.

Based on the above embodiment, the first refresh rate in the embodiment of the present disclosure is the highest refresh rate of the display panel, and the second refresh rate is the lowest refresh rate of the display panel.

An embodiment of the present disclosure further provides a display device comprising:

A display panel and a gamma voltage correction device in the above embodiment.

Wherein the gamma voltage correction device comprises:

A storage module configured to pre-store gamma voltage data, a plurality of vertical blanking intervals, and a refresh rate corresponding to each of the vertical blanking intervals, wherein the gamma voltage data comprises gamma voltages corresponding to a first refresh rate and a second refresh rate that are not equal to each other; an interval obtaining module, configured to obtain interval of a vertical blanking phase in the current frame period of the display panel in real time; a voltage obtaining module, configured to determine a refresh rate corresponding to the interval once every time the interval reaches one of the vertical blanking intervals as a candidate refresh rate, and if the candidate refresh rate is not equal to the first refresh rate and not equal to the second refresh rate, perform interpolation processing on the gamma voltage data based on an interpolation algorithm to obtain a gamma voltage corresponding to the candidate refresh rate; a correction module, configured to use the candidate refresh rate determined last time as a target refresh rate, and use a gamma voltage corresponding to the target refresh rate as a gamma voltage of a display phase in a next frame period of the display panel.

Based on the above embodiment, the voltage obtaining module in the embodiment of the present disclosure is further configured to:

Using a gamma voltage corresponding to the first refresh rate as a gamma voltage corresponding to the candidate refresh rate if the candidate refresh rate is equal to the first refresh rate;

Using a gamma voltage corresponding to the second refresh rate as a gamma voltage corresponding to the candidate refresh rate if the candidate refresh rate is equal to the second refresh rate.

Based on the above embodiment, the interval obtaining module in the embodiment of the present disclosure is specifically configured to:

In a current frame period of the display panel, an end time of a display phase in the current frame period is used as a start time, and a time difference between the start time and the current time is used as the interval.

Based on the above embodiment, the voltage obtaining module in the embodiment of the present disclosure is specifically configured to:

Each time the interval reaches one of the vertical blanking intervals, a refresh rate corresponding to the vertical blanking interval is used as a refresh rate corresponding to the interval.

Based on the above embodiment, the display panel in the embodiment of the present disclosure has a plurality of gray scales, and the gamma voltage comprises a plurality of sub-gamma voltages corresponding to the plurality of gray scales one-to-one.

Based on the above embodiment, the first refresh rate in the embodiment of the present disclosure is the highest refresh rate of the display panel, and the second refresh rate is the lowest refresh rate of the display panel.

Based on the above embodiment, the display device in the embodiment of the present disclosure further comprises:

A timing controller, a scan driving circuit, and a data driving circuit; wherein, The gamma voltage correction device and the scan driving circuit are respectively electrically connected to the timing controller, the data driving circuit is electrically connected to the gamma voltage correction device, and the display panel is respectively electrically connected to the scan driving circuit and the data driving circuit.

Based on the above embodiment, the display device in the embodiment of the present disclosure is a liquid crystal display device or an organic light emitting diode display device.

It should be noted that the display device according to the embodiment of the present disclosure may be referred to FIG. 1. Since the structure of the display device has been described in detail in the above-described embodiment, details are not described herein.

It will be appreciated by those of ordinary skill in the art that equivalents may be substituted or altered in accordance with the technical solution of the present disclosure and its inventive concept, all of which variations or substitutions are intended to fall within the scope of the appended claims.

What is claimed is:

1. A gamma voltage correction method for variable refresh rate mode of a display panel, wherein the gamma voltage correction method comprises:

pre-storing gamma voltage data, a plurality of vertical blanking intervals, and a refresh rate corresponding to each of the vertical blanking intervals, wherein the gamma voltage data comprises gamma voltages corresponding to a first refresh rate and a second refresh rate that are not equal to each other;

obtaining an interval of a vertical blanking phase in a current frame period in real time in the current frame period of the display panel;

each time the interval reaches one of the vertical blanking intervals, determining a refresh rate corresponding to the interval as a candidate refresh rate, and if the candidate refresh rate is not equal to the first refresh rate and not equal to the second refresh rate, performing interpolation processing on the gamma voltage data based on an interpolation algorithm to obtain a gamma voltage corresponding to the candidate refresh rate; and using the candidate refresh rate determined last time as a target refresh rate, and using a gamma voltage corresponding to the target refresh rate as a gamma voltage of a display phase in a next frame period of the display panel.

2. The gamma voltage correction method according to claim 1, wherein the gamma voltage correction method further comprises:

using a gamma voltage corresponding to the first refresh rate as the gamma voltage corresponding to the candidate refresh rate if the candidate refresh rate is equal to the first refresh rate; and using a gamma voltage corresponding to the second refresh rate as the gamma voltage corresponding to the candidate refresh rate if the candidate refresh rate is equal to the second refresh rate.

3. The gamma voltage correction method according to claim 1, wherein in the current frame period of the display panel, the interval of the vertical blanking phase in the current frame period is obtained in real time, specifically comprising:

in the current frame period of the display panel, an end time of a display phase in the current frame period is used as a start time, and a time difference between the start time and a current time is used as the interval.

4. The gamma voltage correction method according to claim 1, wherein each time the interval reaches one of the vertical blanking intervals, determining the refresh rate corresponding to the interval once, specifically comprising:

each time the interval reaches one of the vertical blanking intervals, a refresh rate corresponding to the vertical blanking interval is used as the refresh rate corresponding to the interval.

5. The gamma voltage correction method according to claim 1, wherein the display panel has a plurality of gray scales, and the gamma voltage comprises a plurality of sub-gamma voltages corresponding to the plurality of gray scales one-to-one.

6. The gamma voltage correction method according to claim 1, wherein the first refresh rate is a highest refresh rate of the display panel and the second refresh rate is a lowest refresh rate of the display panel.

7. A gamma voltage correction device for variable refresh rate mode of a display panel, wherein the gamma voltage correction device comprises:

a storage module configured to pre-store gamma voltage data, a plurality of vertical blanking intervals, and a refresh rate corresponding to each of the vertical blanking intervals, wherein the gamma voltage data comprises gamma voltages corresponding to a first refresh rate and a second refresh rate that are not equal to each other;

an interval obtaining module, configured to obtain an interval of a vertical blanking phase in a current frame period of the display panel in real time;

a voltage obtaining module, configured to determine a refresh rate corresponding to the interval once every time the interval reaches one of the vertical blanking intervals as a candidate refresh rate, and if the candidate refresh rate is not equal to the first refresh rate and not equal to the second refresh rate, perform interpolation processing on the gamma voltage data based on an interpolation algorithm to obtain a gamma voltage corresponding to the candidate refresh rate; and a correction module, configured to use the candidate refresh rate determined last time as a target refresh rate, and use a gamma voltage corresponding to the target refresh rate as a gamma voltage of a display phase in a next frame period of the display panel.

8. The gamma voltage correction device according to claim 7, wherein the voltage obtaining module is further configured to:

use a gamma voltage corresponding to the first refresh rate as the gamma voltage corresponding to the candidate refresh rate if the candidate refresh rate is equal to the first refresh rate; and use a gamma voltage corresponding to the second refresh rate as the gamma voltage corresponding to the candidate refresh rate if the candidate refresh rate is equal to the second refresh rate.

9. The gamma voltage correction device according to claim 7, wherein the interval obtaining module is specifically configured to:

in the current frame period of the display panel, an end time of a display phase in the current frame period is used as a start time, and a time difference between the start time and a current time is used as the interval.

10. The gamma voltage correction device according to claim 7, wherein the voltage obtaining module is specifically configured to:

each time the interval reaches one of the vertical blanking intervals, a refresh rate corresponding to the vertical blanking interval is used as the refresh rate corresponding to the interval.

11. The gamma voltage correction device according to claim 7, wherein the display panel has a plurality of gray scales, and the gamma voltage comprises a plurality of sub-gamma voltages corresponding to the plurality of gray scales one-to-one.

12. The gamma voltage correction device according to claim 7, wherein the first refresh rate is a highest refresh rate of the display panel and the second refresh rate is a lowest refresh rate of the display panel.

13. A display device, wherein the display device comprises:

a display panel and a gamma voltage correction device; wherein, the gamma voltage correction device comprises:

a storage module configured to pre-store gamma voltage data, a plurality of vertical blanking intervals, and a refresh rate corresponding to each of the vertical blanking intervals, wherein the gamma voltage data comprises gamma voltages corresponding to a first refresh rate and a second refresh rate that are not equal to each other;

an interval obtaining module, configured to obtain an interval of a vertical blanking phase in a current frame period of the display panel in real time;

a voltage obtaining module, configured to determine a refresh rate corresponding to the interval once every time the interval reaches one of the vertical blanking intervals as a candidate refresh rate, and if the candidate refresh rate is not equal to the first refresh rate and not equal to the second refresh rate, perform interpolation processing on the gamma voltage data based on an interpolation algorithm to obtain a gamma voltage corresponding to the candidate refresh rate; and a correction module, configured to use the candidate refresh rate determined last time as a target refresh rate, and use a gamma voltage corresponding to the target refresh rate as a gamma voltage of a display phase in a next frame period of the display panel.

14. The display device according to claim 13, wherein the voltage obtaining module is further configured to:

use a gamma voltage corresponding to the first refresh rate as the gamma voltage corresponding to the candidate refresh rate if the candidate refresh rate is equal to the first refresh rate; and use a gamma voltage corresponding to the second refresh rate as the gamma voltage corresponding to the candidate refresh rate if the candidate refresh rate is equal to the second refresh rate.

15. The display device according to claim 13, wherein the interval obtaining module is specifically configured to:

in the current frame period of the display panel, an end time of a display phase in the current frame period is used as a start time, and a time difference between the start time and a current time is used as the interval.

16. The display device according to claim 13, wherein the voltage obtaining module is specifically configured to:

each time the interval reaches one of the vertical blanking intervals, a refresh rate corresponding to the vertical blanking interval is used as the refresh rate corresponding to the interval.

17. The display device according to claim 13, wherein the display panel has a plurality of gray scales, and the gamma voltage comprises a plurality of sub-gamma voltages corresponding one-to-one to the plurality of gray scales.

18. The display device according to claim 13, wherein the first refresh rate is a highest refresh rate of the display panel and the second refresh rate is a lowest refresh rate of the display panel.

19. The display device according to claim 13, wherein the display device further comprises:

a timing controller, a scan driving circuit, and a data driving circuit; wherein, the gamma voltage correction device and the scan driving circuit are respectively electrically connected to the timing controller, the data driving circuit is electrically connected to the gamma voltage correction device, and the display panel is respectively electrically connected to the scan driving circuit and the data driving circuit.

20. The display device according to claim 13, wherein the display device is a liquid crystal display device or an organic light emitting diode display device.

* * * * *